US008007130B2

(12) United States Patent
Wu

(10) Patent No.: US 8,007,130 B2
(45) Date of Patent: Aug. 30, 2011

(54) STRING LIGHT CONNECTOR AND THE APPLICATIONS THEREOF

(75) Inventor: Jui-Hsiung Wu, Taipei (TW)

(73) Assignees: Well Shin Technology Co., Ltd., Taipei (TW); Conntek Integrated Solutions Inc., Cudahy, WI (US)

( * ) Notice: Subject to any disclaimer, the term of this patent is extended or adjusted under 35 U.S.C. 154(b) by 205 days.

(21) Appl. No.: 12/491,236

(22) Filed: Jun. 25, 2009

(65) Prior Publication Data

US 2010/0328953 A1 Dec. 30, 2010

(51) Int. Cl.
*F21V 21/00* (2006.01)

(52) U.S. Cl. ..... 362/249.14; 362/249.06; 439/502

(58) Field of Classification Search ..... 362/249.06, 362/249.14; 439/502, 644, 646, 647, 650, 439/653, 638, 639
See application file for complete search history.

(56) References Cited

U.S. PATENT DOCUMENTS 2,653,219 A * 9/1953 Popp ..... 362/399
2,774,048 A * 12/1956 Baenziger ..... 439/476.1
7,633,024 B1 * 12/2009 Gibboney, Jr. ..... 200/51.1

* cited by examiner

*Primary Examiner* — John A Ward

(57) ABSTRACT

A string light assembly includes a string light connector and a lighting module electrically connected with the string light connector. The string light connector includes a cable, a plug connected with one end of the cable, and a socket module connected with the other end of the cable. The socket module has a plurality of interface modules of which at least one is used for connecting the lighting module, and at least one is used for connecting a plug of another string light connector. A plurality of the string light assemblies are connected to form a light string by engaging the plugs and the corresponding interface modules of the socket modules thereof with one of the plugs used for connecting to a power source. The string light assembly is designed to facilitate the connection and disconnection between two string light assemblies so as to conveniently adjust the length of the light string.

12 Claims, 10 Drawing Sheets

STRING LIGHT CONNECTOR AND THE APPLICATIONS THEREOF

BACKGROUND OF THE INVENTION

1. Field of the Invention

The present invention generally relates to a light string in the illumination field, and more particularly to a string light connector and the applications thereof.

2. The Related Art

Generally, people use ornaments, such as Christmas trees, to improve the ambiance of festivals and holidays, but conventional ornaments are not conspicuous enough to attract people. Consequently, a light string is mounted inside or outside the ornament to make the ornament shine. Generally, the light string is formed by series-connecting a plurality of light bulbs with a single conducting cable. As a result, the length of the light string is fixed so that limits the applications of the light string.

SUMMARY OF THE INVENTION

An object of the present invention is to provide a string light assembly and a string light connector. The string light assembly includes the string light connector and a lighting module electrically connected with the string light connector. The string light connector includes a cable, a plug connected with one end of the cable, and a socket module connected with the other end of the cable. The socket module has a plurality of interface modules of which at least one is used for electrically connecting the lighting module, and at least one is used for electrically connecting a plug of another string light connector, wherein both the lighting module and the corresponding interface module are further worn by a locking ring therearound to be locked together, and both the plug of the other string light connector and the corresponding interface module are further worn by another locking ring therearound to be locked together. A plurality of the string light assemblies are connected to form a light string by engaging the plugs and the corresponding interface modules of the socket modules thereof with one of the plugs used for connecting to a power source.

As described above, the string light assembly of the present invention is designed to facilitate the connection and disconnection between two string light assemblies so as to conveniently adjust the length of the light string under various situations.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
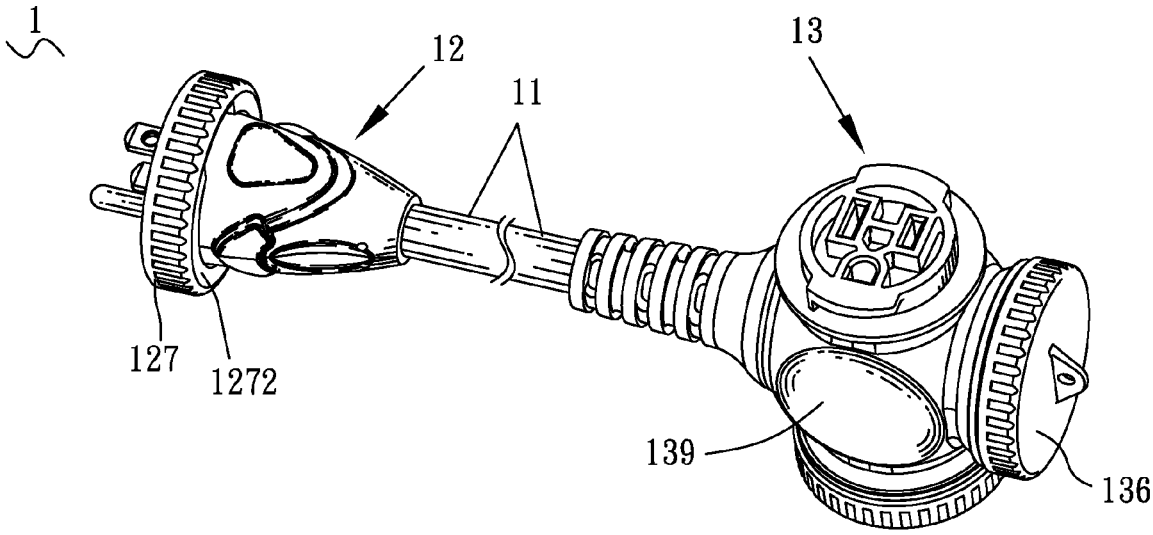
FIG. 1 is a perspective view of a string light connector in accordance with the present invention.
Figure 9:
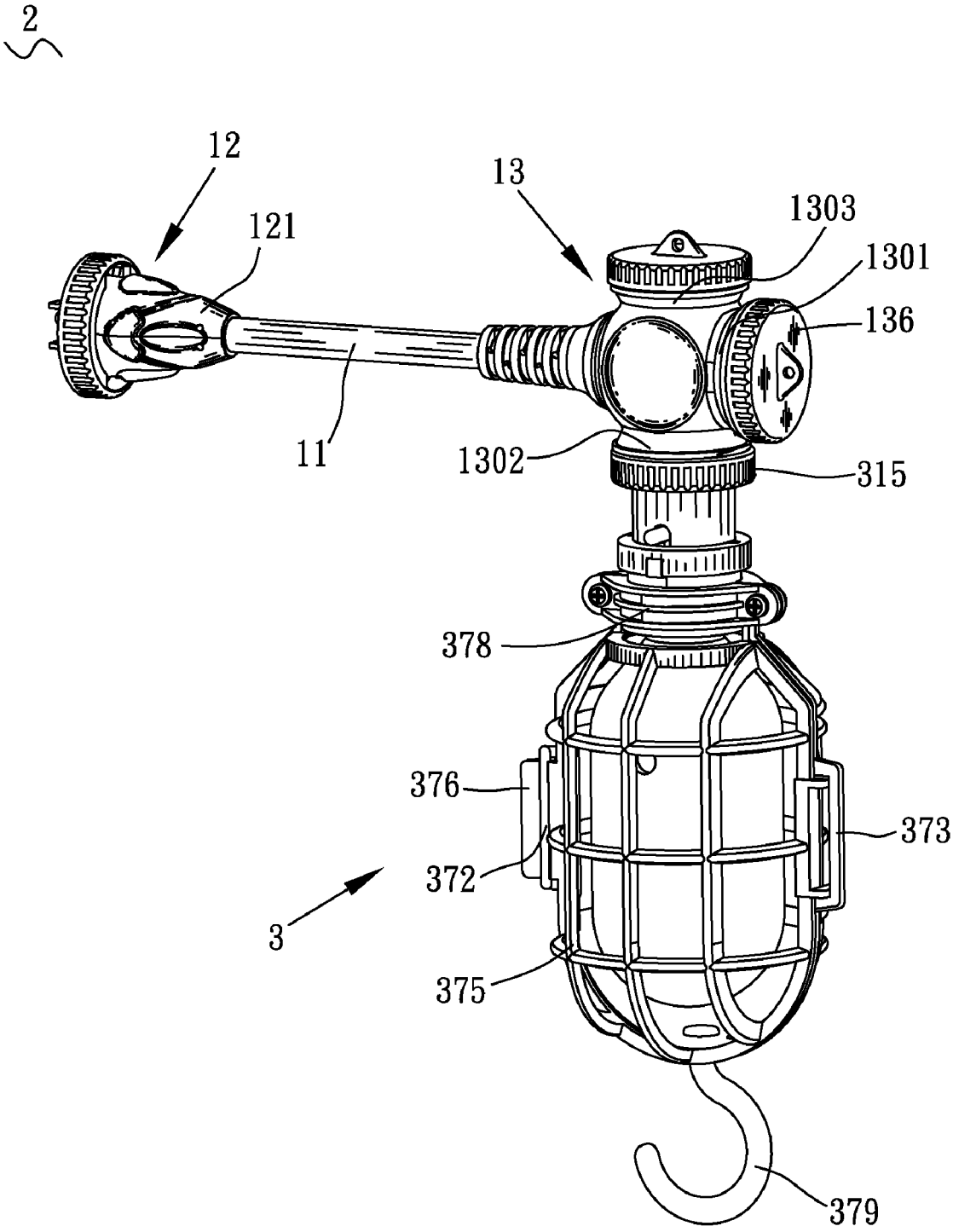
FIG. 9 is a perspective view of a string light assembly according to the present invention.
Figure 10:
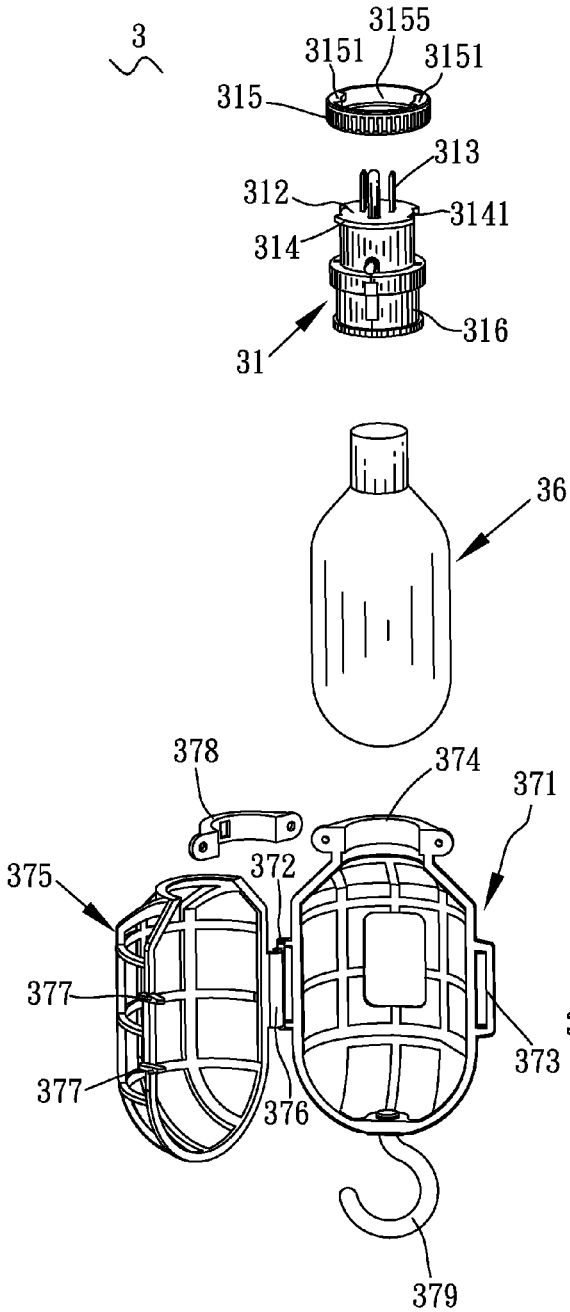
FIG. 10 is an exploded view of a lighting module of the string light assembly of FIG. 9.
Figure 11:
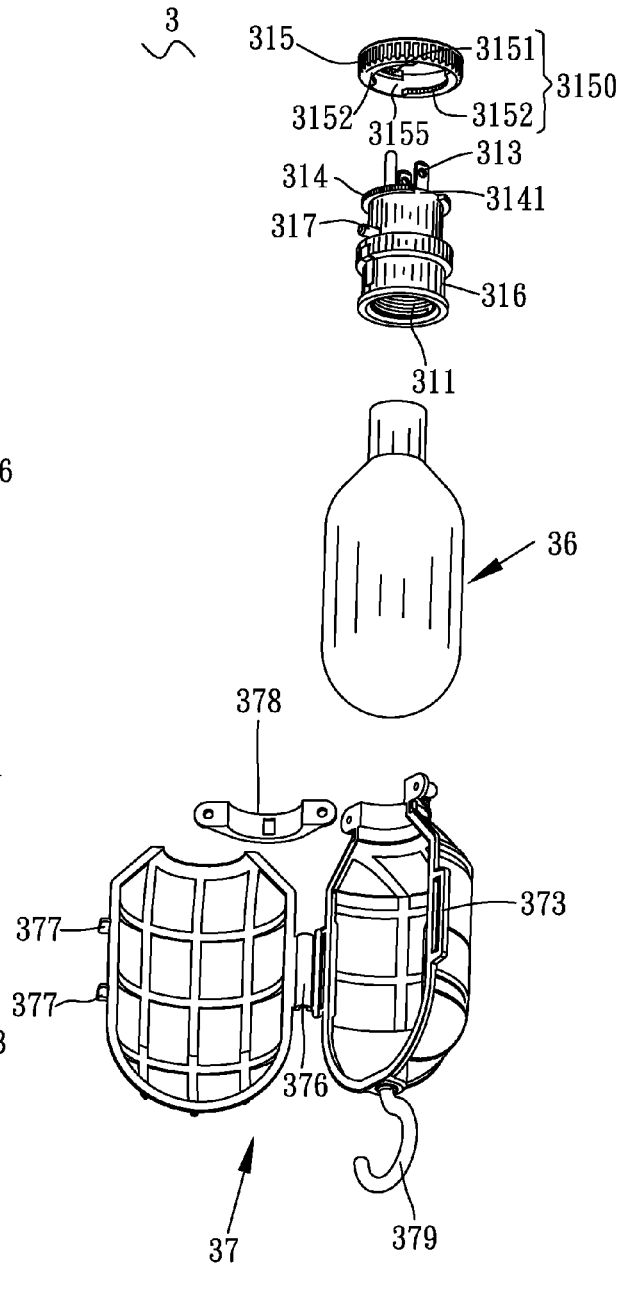
FIG. 11 is another angle exploded view of the lighting module of the string light assembly of FIG. 9.
Figure 12:
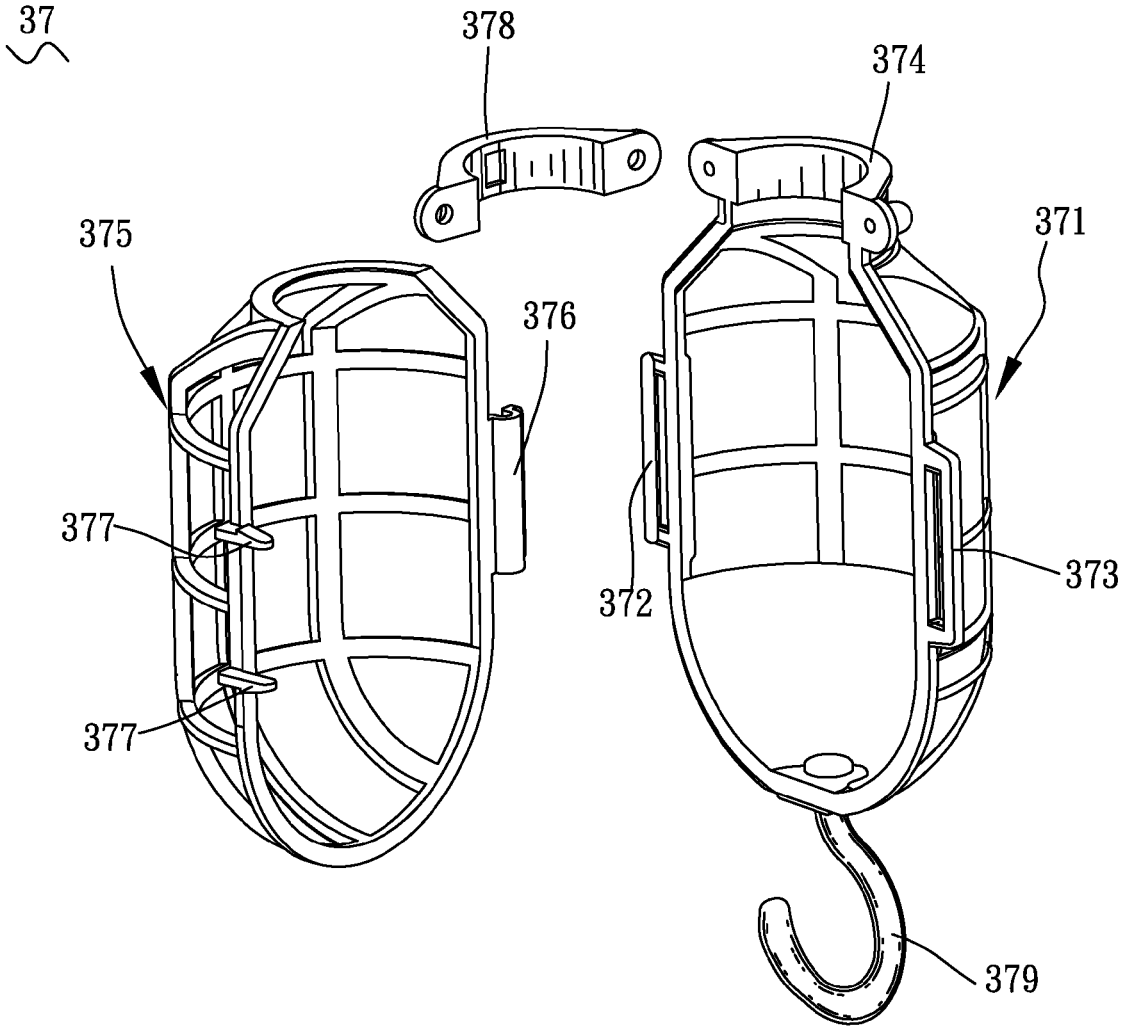
FIG. 12 is an exploded view of a lampshade of the lighting module of FIG. 10.
Figure 13:
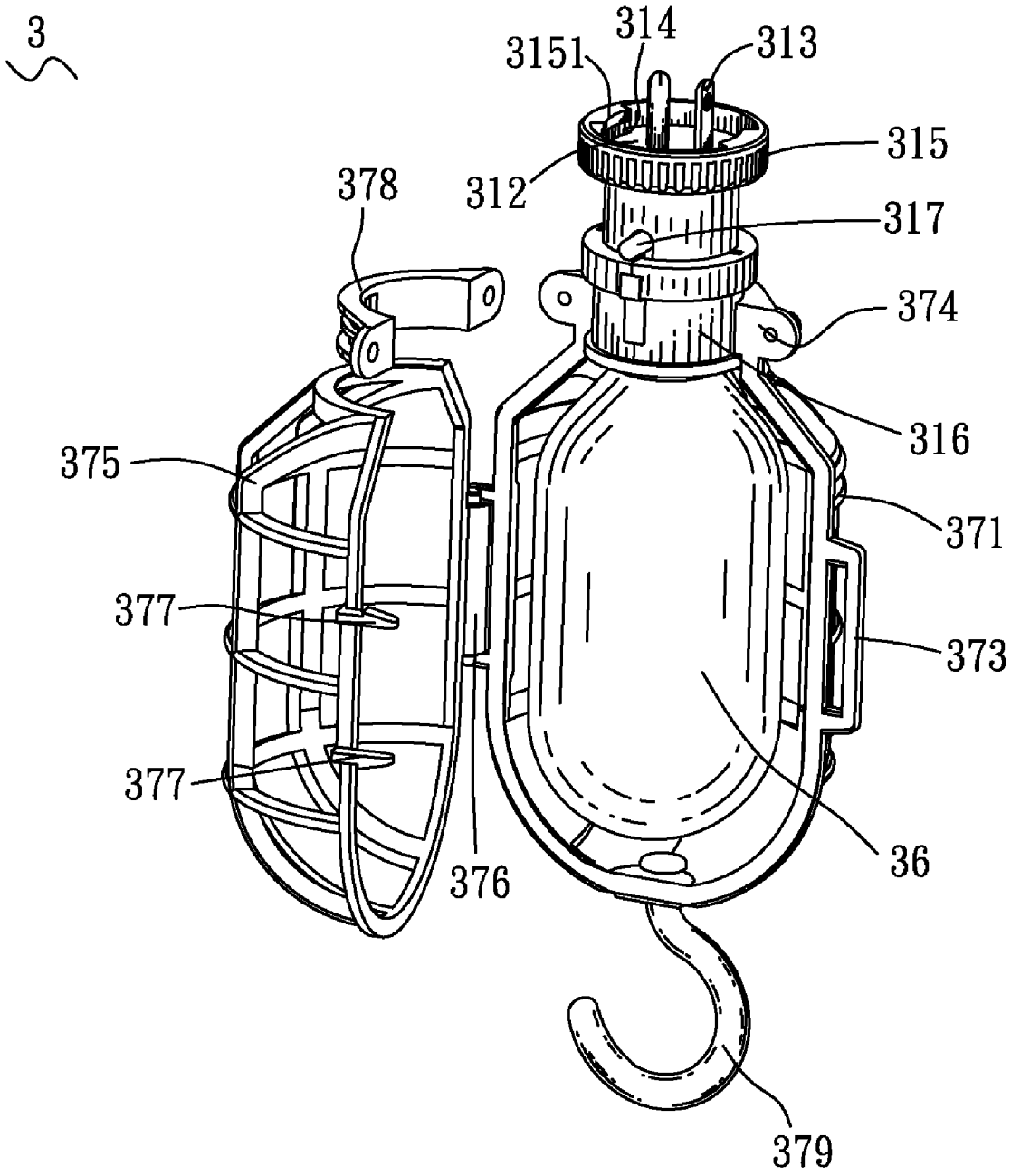
FIG. 13 is a partially assembled view of the lighting module of FIG. 10.
Figure 14:
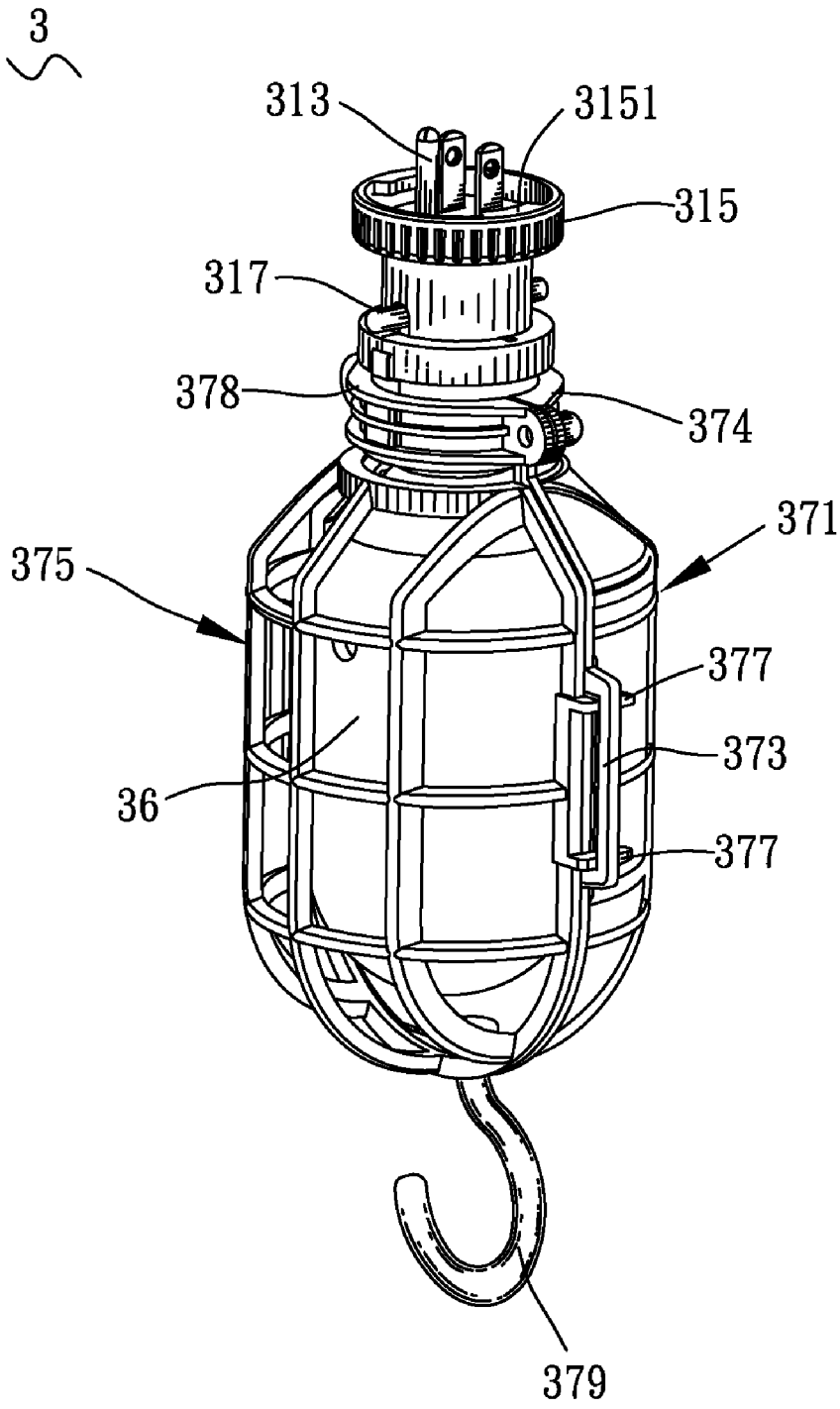
FIG. 14 is a perspective view of the lighting module of the string light assembly of FIG. 9.

With reference to FIG. 1 and FIG. 9, a string light assembly 2 according to the present invention includes a string light connector 1 and a lighting module 3 capable of being electrically connected with the string light connector 1. The string light connector 1 includes a plug 12, a socket module 13 and a cable 11 electrically connecting the plug 12 and the socket module 13.

Figure 2:
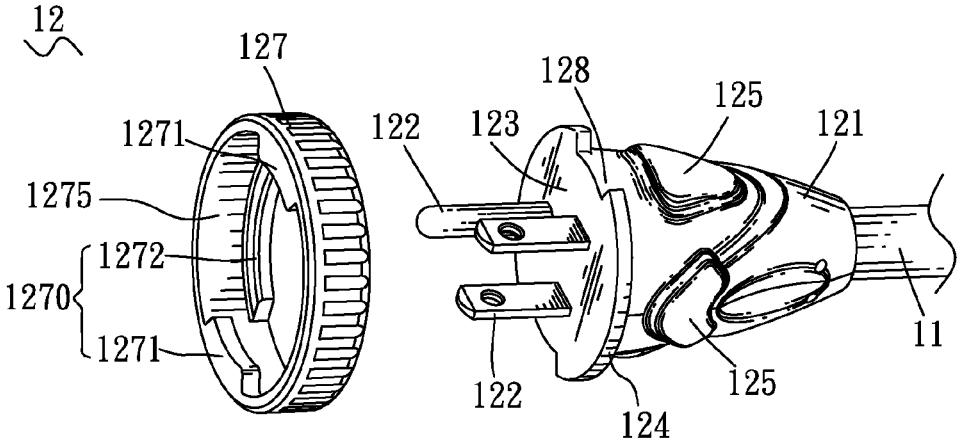
FIG. 2 is an exploded view of a plug of the string light connector of FIG. 1.
Figure 3:
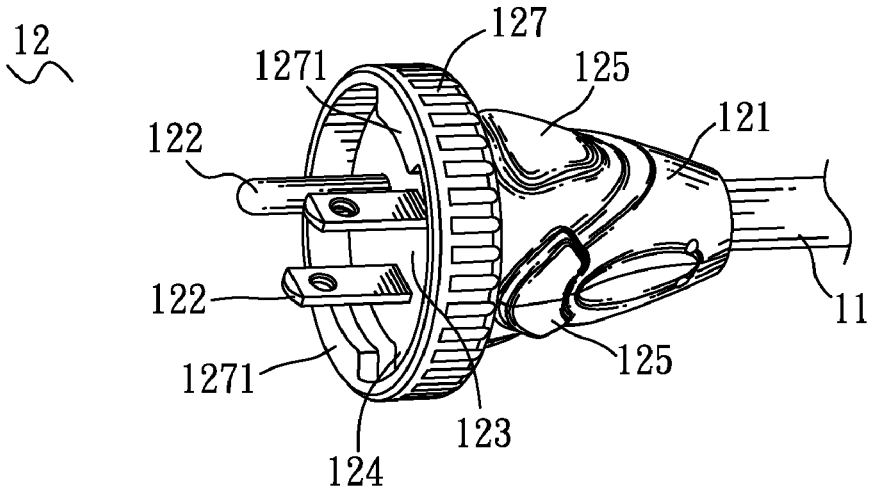
FIG. 3 is a perspective view of the plug of FIG. 2.
Figure 4:
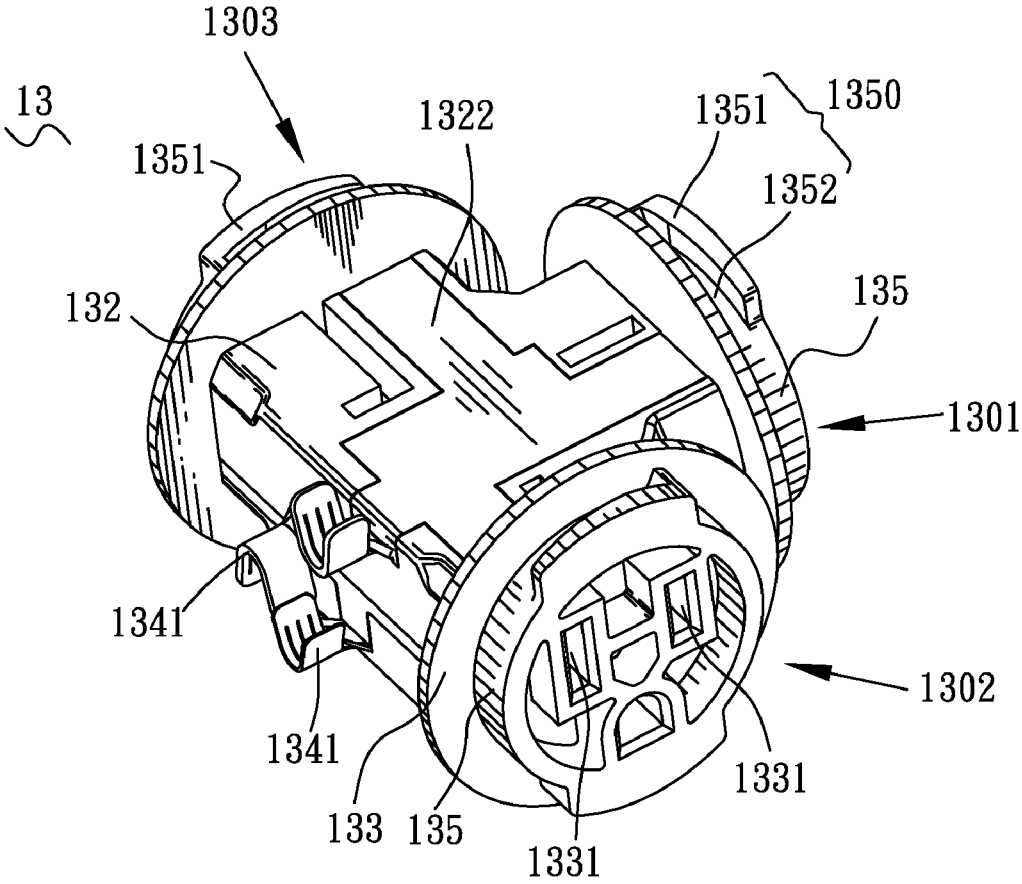
FIG. 4 is a perspective view of a socket module of the string light connector of FIG. 1, without insulating covers and insulating hoods thereon.
Figure 5:
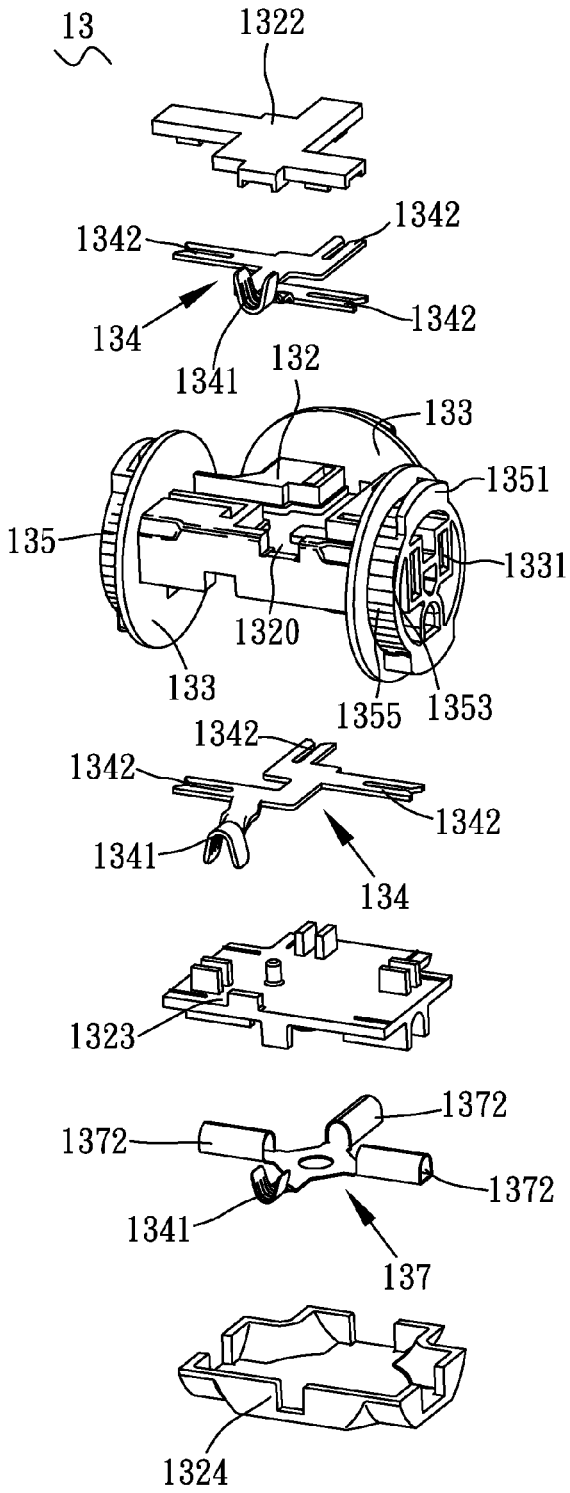
FIG. 5 is an exploded view of the socket module of FIG. 4.
Figure 6:
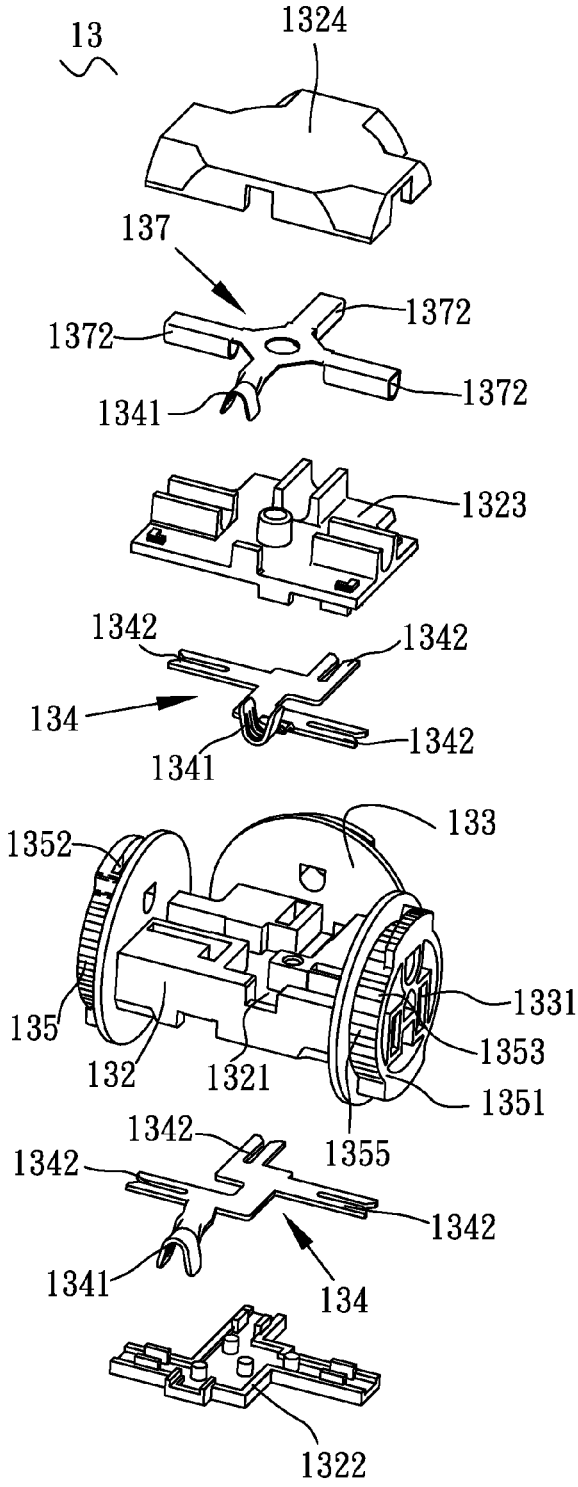
FIG. 6 is another angle exploded view of the socket module of FIG. 4.

Referring to FIGS. 2 and 3, the plug 12 of the string light connector 1 is adapted for being either connected with an external power supply (not shown) or engaged with the socket module 13 of another string light connector 1 so as to provide work power for the corresponding lighting module 3. The plug 12 includes a plug base 121, a plurality of plug terminals 122 and a first locking ring 127. One end of each of the plug terminals 122 is embedded in the plug base 121 for being electrically connected with a conducting wire (not shown) of the cable 11, and the other end thereof stretches out of a mating end 123 of the plug base 121. A peripheral edge of the mating end 123 oppositely protrudes outward to form a pair of first resisting eaves 124 spaced from each other to accordingly define a pair of first guiding openings 128 therebetween. The first locking ring 127 is provided with a first locking structure 1270. The first locking structure 1270 includes a pair of first locking portions 1271 face-to-face protruded inwards from one end rim of the first locking ring 127, and a pair of second locking portions 1272 face-to-face protruded inwards from the other end rim of the first locking ring 127. When the first locking ring 127 is worn around the plug base 121, the second locking portions 1272 pass through the corresponding first guiding openings 128, and then the first locking ring 127 is turned to make the second locking portions 1272 restrained by the corresponding first resisting eaves 124 so as to fasten the first locking ring 127 on the mating end 123 of the plug base 121. The plug base 121 further protrudes outward to form a plurality of projections 125 for preventing the first locking ring 127 from moving toward the cable 11.

Referring to FIGS. 4-6 and FIG. 8, the socket module 13 includes an insulating body 132, a plurality of socket terminals 134, 137 and a plurality of pressing plates 1322, 1323, 1324. The insulating body 132 is of substantially rectangular shape and the side edges thereof are provided with a plurality of pedestals 133. Each of the pedestals 133 defines a plurality of inserting holes 1331. The socket terminals 134, 137 are arranged in the insulating body 132 and each has a connecting tail 1341 for being electrically connected with the corresponding conducting wire of the cable 11 and a plurality of contact tails 1342/1372 respectively inserted in the corresponding inserting hole 1331 of each of the pedestals 133. In order to avoid a short circuit among the socket terminals 134, 137 and secure the socket terminals 134, 137 in the insulating body 132, a plurality of receiving cavities 1320, 1321 are opened on the insulating body 132 and communicate with the corresponding inserting holes 1331 of the pedestals 133 to receive the corresponding socket terminals 134, 137 therein, and each of the socket terminals 134, 137 is further fastened in the respective receiving cavity 1320/1321 by means of pressing the pressing plate 1322/1323/1324 thereon. Moreover, an insulating hood 139 is provided to cap the outside of the insulating body 132 by means of being integrated with the insulating body 132 in a unity mold or other assembled manners for further strengthening the socket module 13. So the socket module 13 defines a plurality of interface modules designated as a first interface module 1301, a second interface module 1302 and a third interface module 1303 of which each may be used for electrically connecting the lighting module 3 or engaging with the plug 12 of another string light connector 1. In this embodiment, the first interface module 1301 is used for engaging with the plug 12 of another string light connector 1, and the second interface module 1302 is used for connecting the lighting module 3.

In order to enhance an engagement between two string light connectors 1 and between the string light connector 1 and the lighting module 3, a middle of each of the pedestals 133 protrudes outward to form a connecting pillar 135. Each of the inserting holes 1331 further penetrates through the corresponding connecting pillar 135. The outer diameter of the connecting pillar 135 is equal to the inner diameter of the first locking ring 127. An outside rim 1353 of the connecting pillar 135 oppositely protrudes outward to form a pair of locking eaves 1351 gradually thickening from one end to the other end along the rim, and accordingly, a pair of locking grooves 1352 is formed between the pedestal 133 and the locking eaves 1351. The locking eaves 1351 and the locking grooves 1352 together define a matching structure 1350 for being buckled with the first locking portions 1271 of the first locking ring 127. When the plug 12 of one string light connector 1 is engaged with the first interface module 1301 of the socket module 13 of another string light connector 1, the first locking ring 127 of the plug 12 is further worn around the corresponding connecting pillar 135, and then is turned to make the first locking portions 1271 restrained by the corresponding locking eaves 1351 and further locked in the respective locking grooves 1352 so as to ensure a firm engagement between the two string light connectors 1 and prevents the two connected string light connectors 1 from disconnecting under external pulling force.

Figure 7:
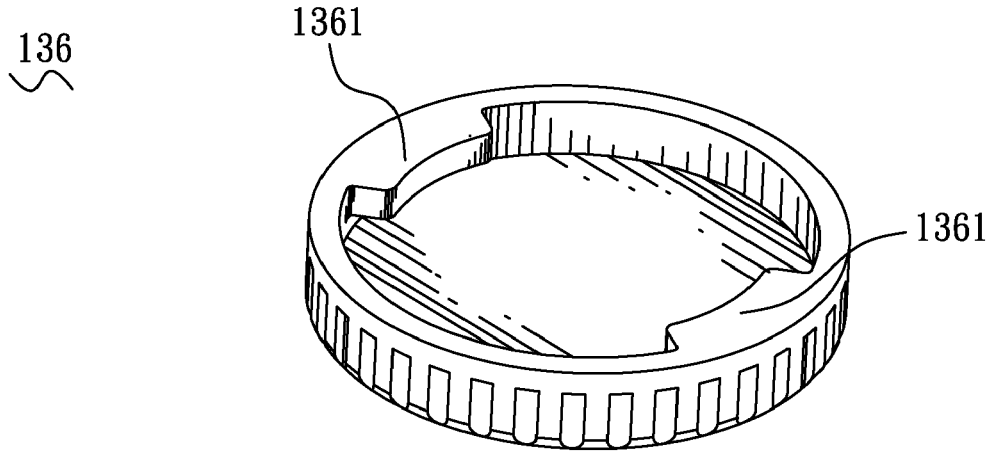
FIG. 7 is a perspective view of the insulating cover of the socket module of the string light connector of FIG. 1.
Figure 8:
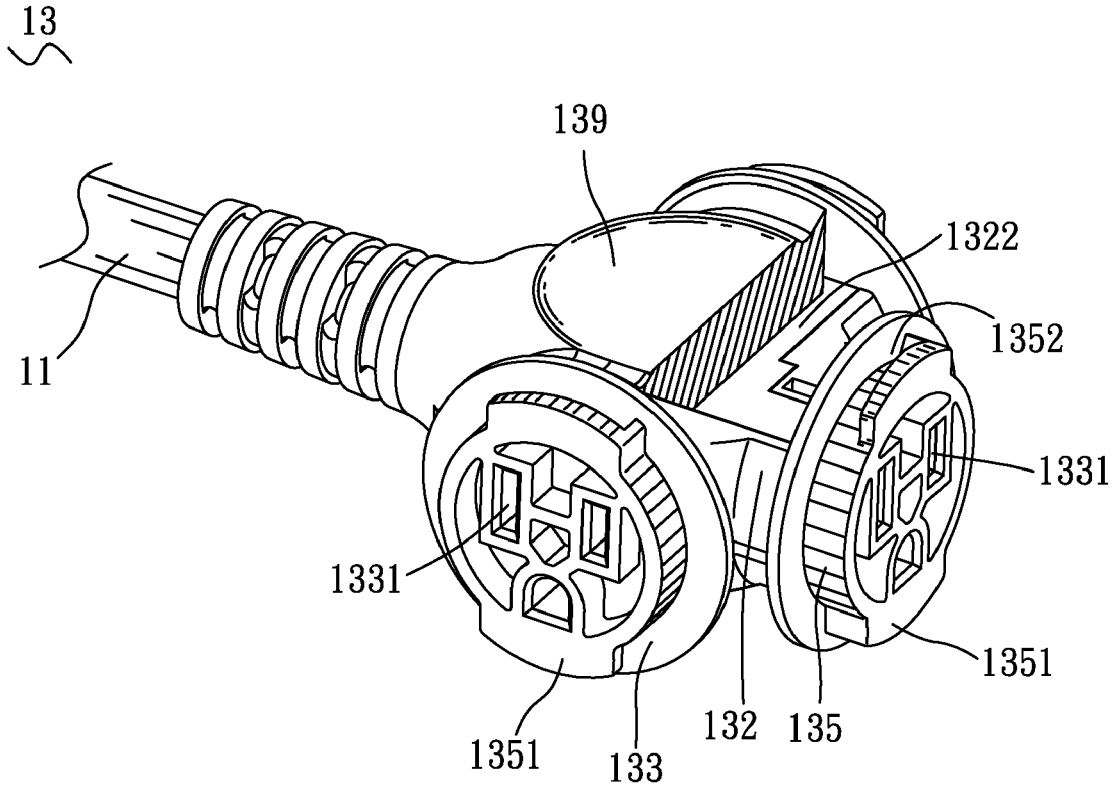
FIG. 8 is a cutaway perspective view of the socket module of the string light connector of FIG. 1.

Referring to FIG. 7 and FIG. 9, the socket module 13 further includes a plurality of cylindrical insulating covers 136 each having a pair of fastening blocks 1361 face-to-face protruded from one end rim thereof. If some interface modules of the socket module 13 are not engaging with the plug 12 or the lighting module 3, such as the third interface module 1303, then the insulating cover 136 will cover the exposed connecting pillar 135 to seal up the inserting holes 1331 for preventing external dusts from entering and damaging the socket module 13. The fastening blocks 1361 are buckled in the corresponding locking grooves 1352 to secure the insulating cover 136 onto the connecting pillar 135.

Referring to FIGS. 9-14, the lighting module 3 is electrically connected with the second interface module 1302 of the socket module 13 of the string light connector 1 by means of an insertion manner and includes a plug-shaped connecting member 31, a light bulb 36 and a lampshade 37.

One end of the connecting member 31 acts as a light holder 311 which has a plurality of electrical contacts (not shown) therein, and the other end thereof acts as a connecting plug 312. The light bulb 36 is held to the light holder 311 and electrically connects the electrical contacts, and the electrical contacts are further electrically connected with a plurality of connecting terminals 313 of the connecting plug 312. So when the connecting plug 312 of the connecting member 31 is engaged with the second interface module 1302 of the socket module 13 to make the connecting terminals 313 inserted in the corresponding inserting holes 1331 and electrically connected with the contact tails 1342, 1372 of the socket terminals 134, 137, a work power can be provided for the light bulb 36 held to the light holder 311. Furthermore, a second locking ring 315 is provided to be worn around the connecting plug 312 and the corresponding connecting pillar 135 of the socket module 13 so as to ensure a firm engagement between the lighting module 3 and the socket module 13, wherein the second locking ring 315 has the same structure as the first locking ring 127 and defines a second locking structure 3150 including a pair of third locking portions 3151 and a pair of fourth locking portions 3152, and accordingly, an end edge of the connecting plug 312 defines a pair of second resisting eaves 314 spaced from each other and a pair of second guiding openings 3141 between the second resisting eaves 314. The manner of the second locking ring 315 securing the lighting module 3 and the string light connector 1 is the same as the manner of the first locking ring 127, securing two string light connectors 1 so it will not be described any more. A peripheral outside of the light holder 311 defines a ring-shaped receiving fillister 316. The connecting member 31 further includes a switch 317 for controlling a switch state of the light bulb 36.

The lampshade 37 includes a semi-ellipsoid first hooding body 371 and a semi-ellipsoid second hooding body 375 mated with each other. One side rim of the first hooding body 371 protrudes outward to form a pivot axle 372 parallel to the rim, and the other side rim thereof is provided with a locking frame 373 opposite to the pivot axle 372. One side rim of the second hooding body 375 protrudes outward to form a pivot eave 376 extending along the rim, and the other side rim thereof opposite to the pivot eave 376 is provided with two locking barbs 377. When the lampshade 37 is assembled, the pivot axle 372 is pivoted in the pivot eave 376 according to a hinge manner to make the first and second hooding bodies 371, 375 pivotally mated with each other so as to envelop the light bulb 36 therebetween for further protecting the light bulb 36. The locking barbs 377 are snapped with the locking frame 373 to secure the first and second hooding bodies 371, 375 together. A top end of the first hooding body 371 is narrowed toward an axis thereof to form a first locking semi-ring 374 mounted in the receiving fillister 316 of the connecting member 31, and a second locking semi-ring 378 is further provided to be screwed with the first locking semi-ring 374 in the receiving fillister 316 to firmly mount the lampshade 37 to the connecting member 31. The lampshade 37 is further provided with a hanger 379 suspended under the first hooding body 371 or the second hooding body 375 so as to hitch onto an external fixed object (not shown), such as Christmas tree and building etc, to secure the string light assembly 2 on the fixed object.

Figure 15:
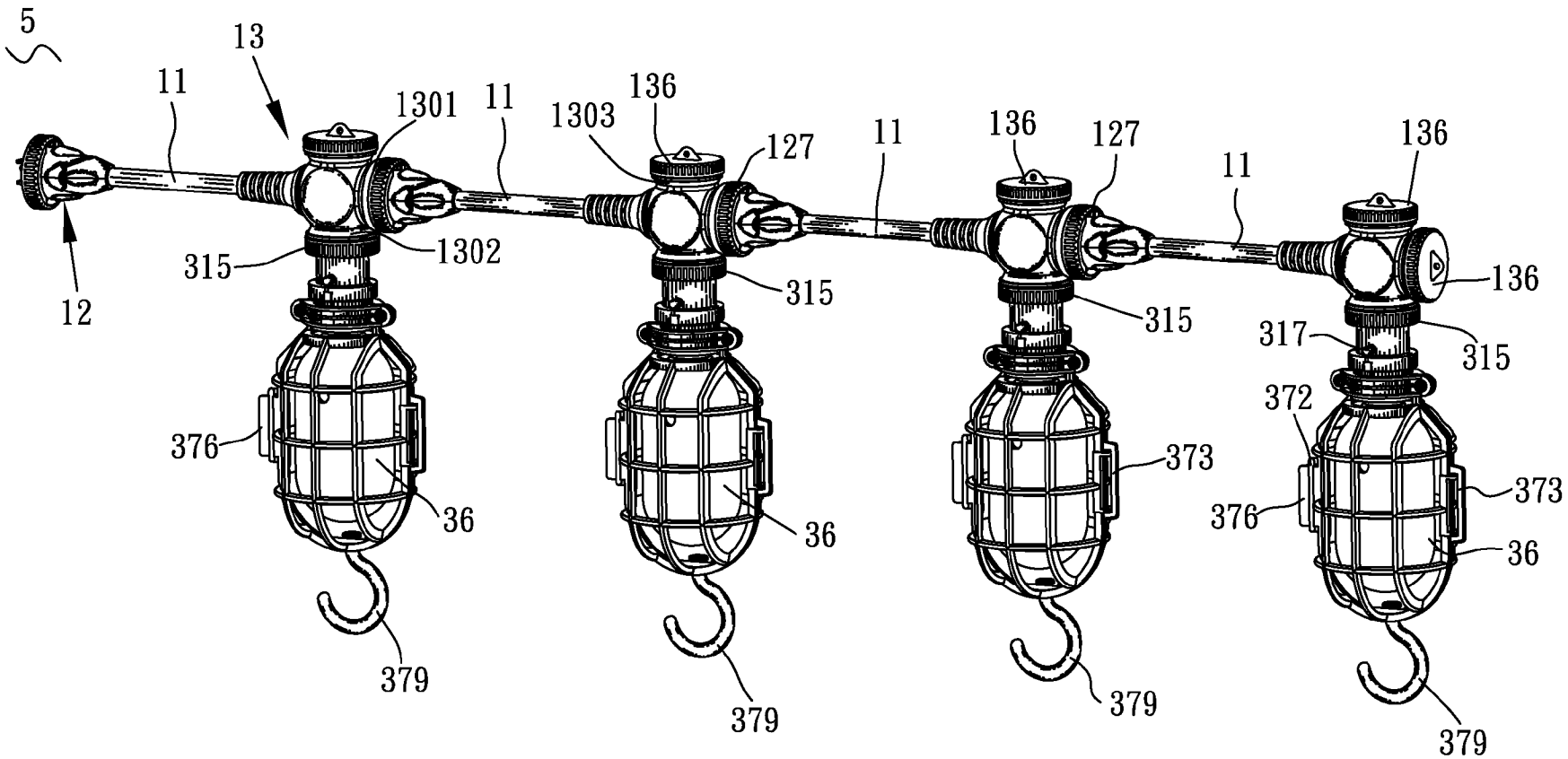
FIG. 15 is a perspective view of a light string formed by the series-connection of a plurality of the string light assemblies of FIG. 9.

Referring to FIG. 15, a light string 5 formed by the series-connection of a plurality of the string light assemblies 2 is shown, wherein the free plug 12 of the outmost string light assembly 2 is used to be electrically connected with the external power supply so as to obtain work power for the light string 5, and the plugs 12 of other string light assemblies 2 are inserted in proper order into the first interface module 1301 of the socket module 13 of the antecedent string light assembly 2. The third interface modules 1303 of the socket modules 13 of the string light assemblies 2 are respectively sealed up by the insulating covers 136. Because of the same structure of the first, second and third interface modules 1301, 1302, 1303 of the socket module 13, it is convenient to assemble the lighting module 3 to the string light connector 1, combine the string light assemblies 2 to form the light string 5, and lengthen the light string 5 without differentiating the first, second and third interface modules 1301, 1302, 1303.

As described above, the string light assembly 2 of the present invention is designed to facilitate the connection and disconnection between two string light assemblies 2 so that the length of the light string 5 can be conveniently adjusted for different circumstances.

The foregoing description of the present invention has been presented for purposes of illustration and description. It is not intended to be exhaustive or to limit the invention to the precise form disclosed, and obviously many modifications and variations are possible in light of the above teaching. For example, both the first locking ring 127 securing the plug 12 to the corresponding connecting pillar 135 and the second locking ring 315 securing the connecting member 31 to the connecting pillar 135 can be also achieved by a screw manner, namely both the first and third locking portions 1271, 3151 of the first and second locking rings 127, 315 and the locking eaves 1351 of the connecting pillar 135 are replaced with screw threads respectively on inner surfaces 1275, 3155 of the first and second locking rings 127, 315 and an outer surface 1355 of the connecting pillar 135 to tooth one another. Such modifications and variations that may be apparent to those skilled in the art are intended to be included within the scope of this invention as defined by the accompanying claims.

What is claimed is:

1. A string light connector, comprising:

a cable;

a plug connected with one end of the cable; and a socket module connected with the other end of the cable, the socket module having a plurality of interface modules of which at least one is used for electrically connecting an external lighting module and at least one is used for electrically connecting a plug of another string light connector, wherein both the lighting module and the corresponding interface module are further worn by a locking ring therearound to be locked together, and both the plug of the another string light connector and the corresponding interface module are further worn by another locking ring therearound to be locked together, wherein the socket module has an insulating body of which side edges are provided with a plurality of pedestals corresponding to the interface modules with each pedestal defining a plurality of inserting holes, a plurality of socket terminals are arranged in the insulating body with each socket terminal having a connecting tail for being electrically connected with the cable and a plurality of contact tails respectively inserted in the corresponding inserting hole of each of the pedestals, and each of the socket terminals is further fastened in the insulating body by means of pressing a pressing plate thereon.

2. The string light connector as claimed in claim 1, wherein the plug has a plug base, the locking ring is worn around the plug base and provided with a locking structure, the pedestal of the socket module protrudes outward to form a connecting pillar provided with a matching structure, the locking ring is further worn around the connecting pillar and the locking structure is buckled with the matching structure to secure the plug to the connecting pillar, and each of the inserting holes further penetrates through the corresponding connecting pillar.

3. The string light connector as claimed in claim 2, wherein the plug base protrudes outward to form a plurality of projections for preventing the locking ring from moving toward the cable.

4. The string light connector as claimed in claim 2, wherein the locking structure is provided with a pair of locking portions face-to-face protruded from one end rim of the locking ring, an outside rim of the connecting pillar oppositely protrudes outward to form a pair of locking eaves, and a pair of locking grooves is formed between the pedestal and the locking eaves for locking the locking portions therein.

5. The string light connector as claimed in claim 2, wherein both the locking structure and the matching structure are provided with screw threads respectively on an inner surface of the locking ring and an outer surface of the connecting pillar to make the locking ring screwed to the connecting pillar.

6. The string light connector as claimed in claim 1, wherein each of the pedestals of the socket module protrudes outward to form a connecting pillar, each of the inserting holes further penetrates through the corresponding connecting pillar, and an insulating cover is further provided to cover an exposed portion of the connecting pillar for sealing up the inserting holes.

7. The string light connector as claimed in claim 6, wherein the insulating cover has a pair of fastening blocks face-to-face protruded from one end rim thereof, an outside rim of the connecting pillar oppositely protrudes outward to form a pair of locking eaves, and a pair of locking grooves is formed between the pedestal and the locking eaves for locking the fastening blocks therein to secure the insulating cover on the connecting pillar.

8. A string light assembly, comprising:

a lighting module; and a string light connector including a cable, a plug connected with one end of the cable, and a socket module connected with the other end of the cable, the socket module having a plurality of interface modules of which at least one is used for electrically connecting the lighting module and at least one is used for electrically connecting a plug of another string light connector;

wherein the lighting module includes a plug-shaped connecting member of which one end acts as a light holder for electrically holding a light bulb, and the other end acts as a connecting plug adapted for being inserted in the corresponding interface module of the string light connector, a locking ring is worn around the connecting plug and provided with a locking structure, and the interface module has a connecting pillar provided with a matching structure for being buckled with the locking structure to secure the connecting member thereto.

9. The string light assembly as claimed in claim 8, wherein the locking structure is provided with a pair of locking portions face-to-face protruded from one end rim of the locking ring, an outside rim of the connecting pillar oppositely protrudes outward to form a pair of locking eaves, and a pair of locking grooves is formed between the outside of the interface module and the locking eaves for locking the locking portions therein.

10. The string light assembly as claimed in claim 8, wherein both the locking structure and the matching structure are provided with screw threads respectively on an inner surface of the locking ring and an outer surface of the connecting pillar to make the locking ring screwed to the connecting pillar.

11. The string light assembly as claimed in claim 8, wherein the lighting module further includes a lampshade mounted to the connecting member for enveloping and protecting the light bulb.

12. The string light assembly as claimed in claim 11, wherein the lampshade is provided with a hanger.

* * * * *